US005819366A

United States Patent [19]

Edin

[11] Patent Number: 5,819,366

[45] Date of Patent: Oct. 13, 1998

[54] WET CLEANING SUCTION NOZZLE

[75] Inventor: Anders Edin, Järfälla, Sweden

[73] Assignee: Aktiebolaget Electrolux, Stockholm, Sweden

[21] Appl. No.: 758,895

[22] Filed: Dec. 2, 1996

[30] Foreign Application Priority Data

Dec. 22, 1995 [SE] Sweden ..... 9504640

[51] Int. Cl.[6] ..... A47L 9/06; A47L 7/00

[52] U.S. Cl. ..... 15/322; 15/367; 15/395; 15/401

[58] Field of Search ..... 15/393, 401, 367, 15/322, 396

[56] References Cited

U.S. PATENT DOCUMENTS

| | | | |
|---|---|---|---|
| 1,086,618 | 2/1914 | Raymond et al. | 15/401 |
| 2,516,246 | 7/1950 | Norris | 15/367 X |
| 2,793,384 | 5/1957 | Ortega | 15/401 X |
| 2,867,835 | 1/1959 | Brown et al. | 15/401 |
| 4,164,055 | 8/1979 | Townsend | 15/401 X |
| 4,244,080 | 1/1981 | Wessel | 15/401 X |
| 4,833,752 | 5/1989 | Merrick | 15/322 |
| 5,060,342 | 10/1991 | Brazier | 15/322 |
| 5,241,724 | 9/1993 | Lim | 15/322 |
| 5,301,387 | 4/1994 | Thomas et al. | 15/322 |
| 5,400,467 | 3/1995 | Hwang | 15/322 X |
| 5,553,349 | 9/1996 | Kilstrom et al. | 15/367 X |

*Primary Examiner*—Chris K. Moore

*Attorney, Agent, or Firm*—Pearne, Gordon, McCoy & Granger LLP

[57] ABSTRACT

A wet cleaning suction nozzle having a suction opening (22) facing the floor and communicating with a nozzle outlet tube (12), scraper blades (24), one located in front of, and one behind, the suction opening as seen in the direction of movement of the nozzle, wherein the lower ends of the scraper blade abut the floor when the nozzle is used. The suction opening (22) is located closer to the floor than fastening points (23) of the scraper blades in the nozzle. The nozzle is used on hard, as well as soft floors, without being converted, and the nozzle includes spacers (31), which prevent the nozzle opening (22) from touching the floor when the nozzle is used on a hard floor, but which permits the suction opening to abut the floor when the nozzle is used on a soft floor.

20 Claims, 2 Drawing Sheets

WET CLEANING SUCTION NOZZLE

BACKGROUND OF THE INVENTION

The present invention relates to a wet cleaning suction nozzle having at least one suction opening facing the floor and communicating with a nozzle outlet tube, scraper blades which are placed in front of and behind the suction opening as seen in the direction of movement of the nozzle, wherein a lower end of the scraper blades abut the floor when the nozzle is used.

Nozzles of the aforementioned-type are known in the art. The nozzles are used for cleaning floors by sucking up dirt together with water or cleaning liquids which have previously been applied to the floor. The liquid and the dirt is collected in a container which is emptied in a sewage system. In order to apply liquid to the surface there usually is an additional container with clean liquid and a pump, by means of which the liquid, via a manually-operated control means, is delivered to an outlet opening close to the nozzle and from which the liquid is spread over the floor. For this type of nozzle the suction opening, as well as the fastening points of the scraper blades, are placed at a comparatively large distance from the surface. However, the known nozzles mentioned above suffer from the disadvantage that they are only suited for use on hard surfaces. If such nozzles are used on soft surfaces, such as carpet, they will not suck up the liquid because the liquid will penetrate into the surface, which means that the distance between the opening and the surface becomes too large for the liquid to be effectively drawn by the suction cleaner. Indeed, the distance between the opening and surface can be shortened by pressing the nozzle against the surface, thereby bending the scraping blades. However, this means that the friction forces become too large, making it difficult to move the nozzle across the surface.

Separate nozzles have, up to now, been used to take up the liquid from soft surfaces. These nozzles are typically provided with an elongated narrow suction opening which is surrounded by an even or flat surface resting on the floor. This arrangement presents a comparatively small frictional resistance when the nozzle is moved in one direction, but a comparatively large frictional resistance when the nozzle is moved in the opposite direction. Accordingly, such nozzles are conventionally moved across the floor in one direction (towards the body of the operator), after which the nozzle is lifted and, when moved in the opposite direction (i.e., away from the operator), is kept above the floor. It should be apparent that this method of use is labor intensive and not desirable.

It is often desirable to mechanically treat localized areas of the soft surface where dirt or soil is sticking to the surface. It is also often desirable, in connection with wet cleaning of hard floors, to dry the surface.

In order to make it possible to remove liquid from hard, as well as soft surfaces, and to achieve mechanical treatment or drying, there are also nozzles on the market which comprise several separate parts that can be combined manually so that the different nozzle types are created. Such nozzles, however, have the disadvantage that changing between the different types of nozzles is cumbersome and unhygienic and demands from the operator that all assembly information and parts to be assembled are accessible at each moment.

SUMMARY OF THE INVENTION

A purpose of the present invention is to achieve a nozzle which permits removal or withdrawal of liquid from hard, as well as soft floors, and which does not have at least some of the disadvantages found in the prior art nozzles mentioned above. Thus, the nozzle according to the present invention can, without being converted, be used on both hard and soft surfaces, and be moved in both directions without any greater resistance and without being lifted from the surface. It is also possible to achieve mechanical treatment or drying solely by turning the nozzle through 180°.

In accordance with the present invention, a wet cleaning suction nozzle has a suction opening facing a floor to be cleaned and communicating with a nozzle outlet tube. A pair of scraper blades are secured to the suction nozzle, one blade being in front of the suction opening and one blade being behind the suction opening, as seen in the direction of nozzle movement.

In further accordance with the present invention, the suction opening is located relatively closer to the floor than are fastening points of the scraper blades to the suction nozzle. The nozzle includes a spacer which prevents the suction opening from touching the floor when the nozzle is used on a hard surface, but which permits the suction opening to abut the floor when the nozzle is used on a soft surface.

In further accordance with the present invention, scraper blade holders are secured to the suction nozzle and pivotally receive the scraper blades. The scraper blades pivot to move toward or away from the suction opening and reduce frictional resistance to movement of the suction nozzle as the nozzle is moved back and forth across a floor.

BRIEF DESCRIPTION OF THE DRAWINGS

These and further features of the present invention will be apparent with reference to the attached drawings, wherein.

DETAILED DESCRIPTION OF THE PREFERRED EMBODIMENT

Figure 1:
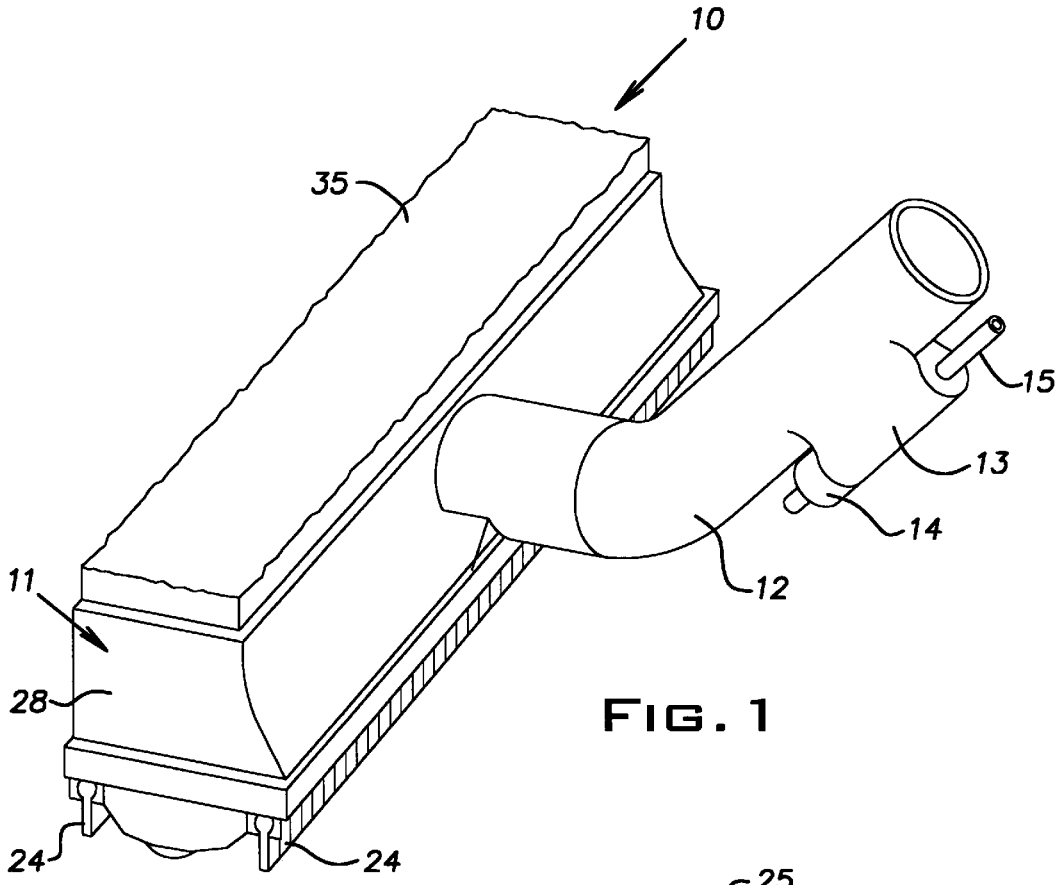
FIG. 1 is a perspective view of a nozzle according to the present invention.

With reference to the drawing figures, the nozzle 10 comprises a front nozzle part 11 and a rear tube-shaped part 12 which are turnably or pivotally connected to each other. The tube-shaped part 12, which is connected to a vacuum source, has a support 13 for a spray nozzle 14 by means of which liquid, for instance cleaning liquid, can be sprayed on the surface to be cleaned. The spray nozzle 14 is connected to a hose 15 through which liquid is supplied to the nozzle 14. The supply of liquid is controlled by means of control means arranged on the tube shaft (not shown) which is connected to the tube-shaped part 12.

Figure 2:
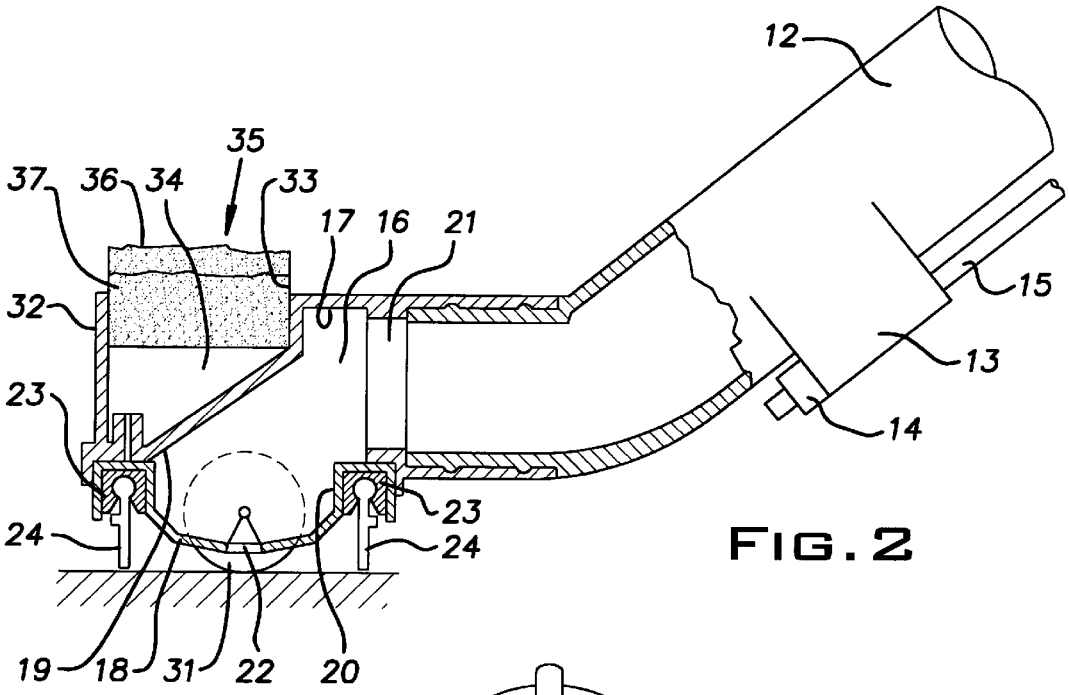
FIG. 2 is a partially-broken vertical section through the nozzle shown in FIG. 1.

With reference to FIG. 2, the nozzle part 11 has an elongated shape and is provided with a chamber 16 delimited or defined by an upper wall part 17, a lower wall part 18, a front wall part 19, a rear wall part 20, and inner side wall parts 21. The lower wall part 18 has a central portion which is placed close to the surface on which the nozzle 10 is moved. The lower wall part central portion has an elongated slot-shaped opening 22 formed therein which serves as a suction opening (FIGS. 2, 3).

Figure 4:
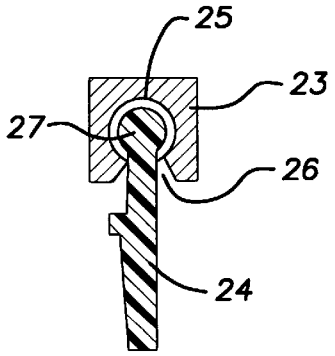
FIG. 4 is an enlarged sectional view of a detail of the nozzle.

In front of and behind the opening 22, there is a holder 23 for a scraper blade 24. The holder 23 and scraper blade extend generally the complete width of the nozzle part 11. The holder 23, which is spaced a relatively greater distance from the surface than the suction opening 22 is spaced from the surface, has a cylinder-shaped recess 25 formed therein. The recess 25 has a downwardly-extending elongated slot 26 through which the scraper blade 24 extends (FIG. 4). The width of the slot 26 is relatively larger than the thickness of the scraper blade 24, and the width of the slot 26 increases as the slot advances or extends toward the floor.

The upper part of the scraper blade 24 is provided with a cylinder-shaped bead 27 which is inserted into the recess 25. The diameter of the bead is slightly less than the diameter of the recess 25, which permits the scraper blade 24 to turn or tilt with respect to the recess 25. Tilting or turning of the scraper blade 24 permits the scraper blade 24 to fold toward or away from the suction opening 22 when the nozzle 10 is moved on a surface. Such tilting or turning reduces the resistance to movement as compared to a nozzle having fixed scraper blades. Preferably, the scraper blade 24 consists of rubber or plastics and has a corrugated surface facing outwardly (FIG. 1).

Figure 3:
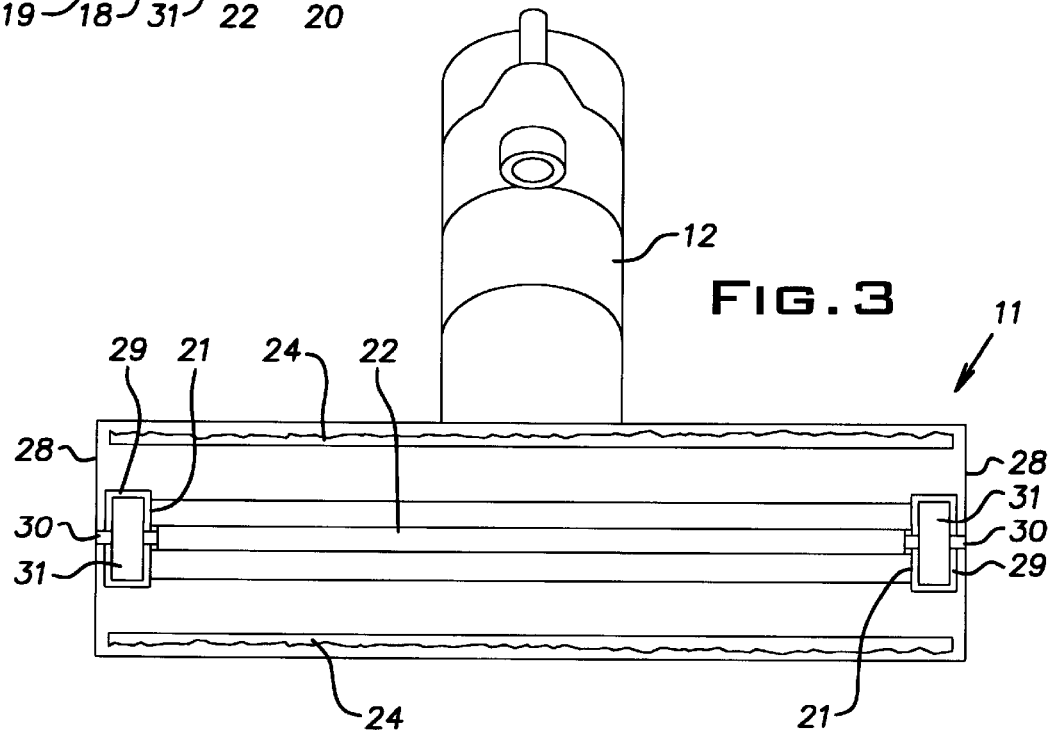
FIG. 3 is a bottom plan view of the nozzle according to the present invention.

The nozzle part 11 also has outer side wall parts 28 that, together with the inner side wall parts 21, form a pocket 29 at each end of the nozzle part 11 (FIGS. 1 and 3). The side wall parts 28, 21 are provided with recesses in which a shaft 30, which is provided with a wheel 31, is secured. The lower part of the wheels 31 extend below the suction opening 22 and serve, at certain occasions, as a distance or spacing means to maintain a gap or space between the surface and the suction opening 22, whereas the scraper blades 24 have a length such that they extend relatively below the lower parts of the wheels 31.

Further, the nozzle part 11 has a vertical front wall portion 32 which, together with the outer side wall parts 28, a rear vertical wall portion 33, and a bottom comprising vertical flanges 34, forms an upwardly open pocket in which a body 35 of elastic material is inserted. The body 35, which can easily be removed from the pocket, preferably comprises an upper layer 36 of abrasive, grinding or polishing material and a lower layer 37 of a liquid-absorbent material, for instance, foamed plastic. Therefore, the body 35 can be removed from the pocket, and inverted to alternatively expose the abrasive or the liquid-absorbent surface.

Use of the nozzle 10 according to the present invention will be described hereafter with reference to the drawing figures and the foregoing description. First, a cleaning agent is applied to the floor surface to be cleaned, and this can be done by means of the spray nozzle 14. Then, the liquid is sucked or drawn from the floor by moving the nozzle part 11, regardless of the type of floor, forwards and backwards on the floor. When working on hard floors, the suction opening 22 is placed immediately above the floor since the nozzle 10 rests on the wheels 31 at the same time that the scraping blades 24, when moving the nozzle across the floor, have pivoted or turned about their support points 25. As such, the scraping blades 24 serve as suction curtains to concentrate the suction forces in the floor area beneath the suction opening 22 and between the scraping blades 24.

When the nozzle is moved on a soft floor, the wheels 31 sink down into the floor so that the portions surrounding the suction opening 22 (i.e., lower wall 18) will abut the surface, and thereby provide a good suction effect on the liquid that has penetrated into the surface. Also in this case, the scraping blades 24 will be folded away, which means that they will not hinder the nozzle from being moved on the surface. In case it is necessary to treat the surface in order to get rid of spots or soil which is stuck to the surface, or in order to take up remaining water, the nozzle part 11 can easily be pivoted half a turn, after which the outwardly-facing side of the body 35 is brought in contact with the floor.

It should be mentioned that it is contemplated to replace the wheels by other types of distance means (i.e., sliding elements), if desired. It is also contemplated that the shape of the suction opening could be varied or re-configured.

Although the preferred embodiments of this invention have been shown and described, it should be understood that various modifications and rearrangements of the parts may be resorted to without departing from the scope of the invention as disclosed and claimed herein.

What is claimed is:

1. A wet cleaning suction nozzle comprising a nozzle part (11) defining at least one suction opening (22) facing the floor and communicating with a nozzle outlet tube (12), a pair of scraper blades (24) secured to said nozzle part, one of said blades being placed in front of the suction opening as seen in the direction of movement of the nozzle and the other of said blades being placed in behind of the suction opening as seen in the direction of nozzle movement, a lower end of the scraper blades abutting the floor when the nozzle is used, wherein the suction opening (22) is in a fixed position relative to fastening points (23) of the scraper blades in the nozzle and is located vertically closer to the floor than said fastening points (23) are vertically located from the level of said suction opening, and wherein the nozzle is intended to be used on hard as well as soft floors, the nozzle part comprising at least one spacer (31) which rides upon and holds the nozzle opening (22) above the floor when the nozzle is used on a hard floor but which sinks into a soft floor covering and thereby permits the suction opening to abut the floor covering when the nozzle is used on a soft floor.

2. A nozzle according to claim 1, wherein the suction opening (22) is shaped as an elongated slot.

3. A nozzle according to claim 1, wherein the said at least one spacer comprises a plurality of wheels, said wheels being placed adjacent side walls (28) of the nozzle part.

4. A wet cleaning suction nozzle comprising a nozzle part (11) defining at least one suction opening (22) facing the floor and communicating with a nozzle outlet tube (12), a pair of scraper blades (24) pivotally secured to said nozzle part, one of said blades being placed in front of the suction opening as seen in the direction of movement of the nozzle and the other of said blades being placed behind the suction opening as seen in the direction of nozzle movement, a lower end of the scraper blades abutting the floor when the nozzle is used, wherein the suction opening (22) is located relatively closer to the floor than fastening points (23) of the scraper blades in the nozzle and wherein the nozzle is intended to be used on hard as well as soft floors, the nozzle part comprising at least one spacer (31) which rides upon and holds the nozzle opening (22) above the floor when the nozzle is used on a hard floor but which sinks into a soft floor covering and thereby permits the suction opening to abut the floor covering when the nozzle is used on a soft floor.

5. A nozzle according to claim 4, wherein an upper end of the scraper blades include a bead (27) which is inserted into an elongated recess (25) in the nozzle part.

6. A nozzle according to claim 1, wherein the scraper blades (24) are made of rubber or plastics.

7. A wet cleaning suction nozzle comprising a nozzle part (11) defining at least one suction opening (22) facing the floor and communicating with a nozzle outlet tube (12), a pair of scraper blades (24) secured to said nozzle part, one of said blades being placed in front of the suction opening as seen in the direction of movement of the nozzle and the other of said blades being placed in behind of the suction opening as seen in the direction of nozzle movement, a lower end of the scraper blades abutting the floor when the nozzle is used, wherein the suction opening (22) is in a fixed position relative to fastening points (23) of the scraper blades in the nozzle and is located relatively closer to the floor than said fastening points (23) and wherein the nozzle is intended to be used on hard as well as soft floors, the nozzle part comprising at least one space (31) which rides upon and holds the nozzle opening (22) above the floor when the nozzle is used on a hard floor but which sinks into a soft floor covering and thereby permits the suction opening to abut the floor covering when the nozzle is used on a soft floor, and further comprising means (14) for distributing liquid to the floor.

8. A nozzle according to claim 1, further comprising a link by means of which the outlet tube (12) is turnably connected to said nozzle part (11).

9. A wet cleaning suction nozzle comprising a nozzle part (11) defining at least one suction opening (22) facing the floor and communicating with a nozzle outlet tube (12), a pair of scraper blades (24) secured to said nozzle part, one of said blades being placed in front of the suction opening as seen in the direction of movement of the nozzle and the other of said blades being placed in behind of the suction opening as seen in the direction of nozzle movement, a lower end of the scraper blades abutting the floor when the nozzle is used, wherein the suction opening (22) is in a fixed position relative to fastening points (23) of the scraper blades in the nozzle and is located relatively closer to the floor than said fastening points (23) and wherein the nozzle is intended to be used on hard as well as soft floors, the nozzle part comprising at least one spacer (31) which rides upon and holds the nozzle opening (22) above the floor when the nozzle is used on a hard floor but which sinks into a soft floor covering and thereby permits the suction opening to abut the floor covering when the nozzle is used on a soft floor, wherein said nozzle part comprises a surface which is used for drying or mechanically treating the floor.

10. A nozzle according to claim 9, wherein said surface is a part of an element (35) which is removably secured to an upper side of the nozzle part.

11. A nozzle according to claim 1, further comprising a pair of holders, each of said holders being secured to said nozzle part and having one of said scraper blades secured thereto.

12. A nozzle according to claim 11, wherein each of said holders defines an elongated recess and a slot, and wherein an upper end of said scraper blade has a bead which is received within said elongated recess.

13. A wet cleaning suction nozzle comprising a nozzle part (11) defining at least one suction opening (22) facing the floor and communicating with a nozzle outlet tube (12), a pair of holders secured to said nozzle part, each of said holders defining an elongated recess and a slot, a pair of scraper blades (24) pivotally secured to an associated one of said pair of holders and having an upper end defining a bead which is received within the holder elongated recess, one of said scraper blades being placed in front of the suction opening as seen in the direction of movement of the nozzle and the other of said blades being placed behind the suction opening as seen in the direction of nozzle movement, a lower end of the scraper blades abutting the floor when the nozzle is used, wherein the suction opening (22) is located relatively closer to the floor than fastening points (23) of the scraper blades in the holders and wherein the nozzle is intended to be used on hard as well as soft floors, the nozzle part comprising at least one spacer (31) which rides upon and holds the nozzle opening (22) above the floor when the nozzle is used on a hard floor but which sinks into a soft floor covering and thereby permits the suction opening to abut the floor covering when the nozzle is used on a soft floor.

14. A nozzle according to claim 13, wherein the suction opening (22) is shaped as an elongated slot.

15. A nozzle according to claim 13, wherein the scraper blades (24) are made of rubber or plastics.

16. A nozzle according to claim 13, further comprising means (14) for distributing liquid to the floor.

17. A nozzle according to claim 13, further comprising a link by means of which the outlet tube (12) is turnably connected to said nozzle part (11).

18. A nozzle according to claim 13, wherein said nozzle part comprises a surface which is used for drying or mechanically treating the floor.

19. A nozzle according to claim 18, wherein said surface is a part of an element (35) which is removably secured to an upper side of the nozzle part.

20. A nozzle according to claim 1, wherein said nozzle part includes a lower wall part, said lower wall part extending downwardly and having a central, downwardmost portion, said suction opening being formed in said lower wall part at said central downwardmost portion.

* * * * *

UNITED STATES PATENT AND TRADEMARK OFFICE

CERTIFICATE OF CORRECTION

PATENT NO. : 5,819,366

DATED : October 13, 1998

INVENTOR(S) : Edin

It is certified that error appears in the above-identified patent and that said Letters Patent is hereby corrected as shown below:

Column 5, Line 12, Claim 7, delete "space" and insert --spacer--.

Signed and Sealed this

Twelfth Day of January, 1999

*Attest:*

*Attesting Officer*

*Acting Commissioner of Patents and Trademarks*